United States Patent [19]

Wüster

[11] Patent Number: 4,622,797

[45] Date of Patent: Nov. 18, 1986

[54] DOUBLE-FACED WEBBED PANEL UNIT, WHICH IS BORDERED AT ITS EDGES BY SECTIONS WHICH ABUT AT AN ANGLE TO EACH OTHER

[76] Inventor: Heinrich Wüster, Auwerk 18, A-6460 Imst/Tirol, Austria

[21] Appl. No.: 772,658

[22] Filed: Sep. 4, 1985

[30] Foreign Application Priority Data

Sep. 7, 1984 [AT] Austria ..... 2873/84

[51] Int. Cl.[4] ..... E04C 2/00; E04C 2/20; E04C 2/38

[52] U.S. Cl. ..... 52/785; 52/656; 52/782; 52/806; 52/823

[58] Field of Search ..... 52/782, 783, 785, 806, 52/823, 656

[56] References Cited

U.S. PATENT DOCUMENTS

| | | | |
|---|---|---|---|
| 2,833,003 | 5/1958 | Bourne et al. | 52/823 |
| 3,438,164 | 4/1969 | Duepree | 52/785 X |
| 3,834,101 | 9/1974 | Wilder et al. | 52/823 X |

FOREIGN PATENT DOCUMENTS

| | | | |
|---|---|---|---|
| 232030 | 1/1961 | Australia | 52/656 |
| 1108407 | 6/1961 | Fed. Rep. of Germany | 52/823 |
| 963054 | 12/1949 | France | 52/785 |
| 1206395 | 9/1970 | United Kingdom | 52/785 |

*Primary Examiner*—Alfred C. Perham
*Attorney, Agent, or Firm*—Kurt Kelman

[57] ABSTRACT

A webbed panel unit having two facings bordered at its edges by sections which abut at an angle to each other. Two abutting sections are connected to each other and to the double-faced webbed panel by a two-legged corner angle member, which is disposed in a cutout of the double-faced webbed panel. The legs of the angle member extend in and snugly conform to the ends of the two sections. The two facings of the webbed panel unit have edge portions which protrude into the sections. At least at one end of each section each edge portion is disposed in between the corner angle member and the adjacent inside surface of the section.

8 Claims, 5 Drawing Figures

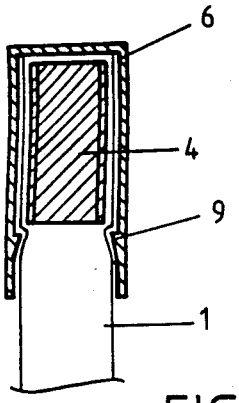
FIG. 3
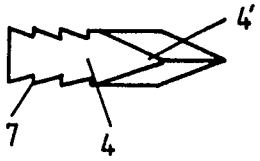
FIG. 5
FIG. 4
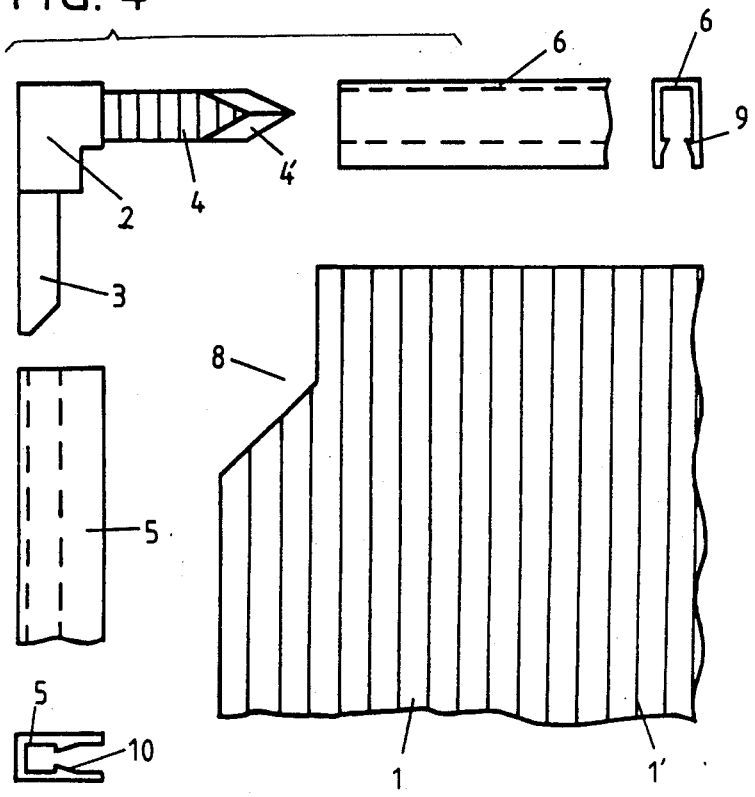

DOUBLE-FACED WEBBED PANEL UNIT, WHICH IS BORDERED AT ITS EDGES BY SECTIONS WHICH ABUT AT AN ANGLE TO EACH OTHER

In greenhouses and hotbeds used in horticulture, the glass panes preferred in the past are increasingly replaced by highly transparent double-faced webbed panels made of plastic. Whereas glass is relatively heavy and breaks easily and have very poor heat insulation properties, double-faced webbed panels distinguish by being extremely light in weight and absolutely resistant to breakage and having extremely favorable heat insulation properties. The double-faced webbed panel comprises two facings, which are spaced apart by longitudinally extending webs so that a multiplicity of air chambers are formed.

Owing to their cellular structure, said panels have inherently an adequate stiffness even in case of small wall thicknesses. But the cellular walls are so flexible that structures covering large areas can be made only from assembled units, which are reinforced by edge sections. Because small wall thicknesses must be used for an economical manufacture and the plastic used for the panels has a high elasticity, the joining of the cellular walls to the required sections is extremely difficult. For this reason, conventional fasteners, such as screws or rivets, cannot be used. A further difficulty is due to the differential thermal expansion of the plate and the reinforcing sections.

Particularly in the manufacture of panel structures which cover large areas and are angled as desired, such as are required for side walls or covered windows of greenhouses and which are required to be bordered on all sides by supporting or covering sections, a reliable joint has not been disclosed before.

It is an object of the invention to provide a double-faced webbed panel unit which is provided at its edges with stiffening sections which are reliably joined to the double-faced webbed panel whereas movements caused by differential thermal expansion are permitted.

This is accomplished in accordance with the invention in that two abutting sections are connected to each other and to the double-faced webbed panel by a two-legged corner angle member, which is disposed in a cut-out of the double-faced webbed panel and the legs of which extend in and snugly conform to the ends of the two sections, and at least at one end of the section each of those edge portions of the two facings of the double-faced webbed panel which protrude into the interior of the section is disposed between that leg of the corner angle member that has been inserted into the end of the section and the adjacent inside surface of the section. That design ensures a joint of optimum strength between the double-faced webbed panel and at least two sections extending at an angle to each other and permits a differential thermal expansion because the double-faced webbed panel is fixed only at points.

The invention will now be explained in more detail with reference to an illustrative embodiment shown on the drawings, in which FIG. 1 is a transverse sectional view showing a double-faced webbed panel, FIG. 2 shows a corner of a rectangular double-faced webbed panel unit.

FIG. 3 is a sectional view taken on line A—A in FIG. 2.

FIG. 4 shows the separate parts forming the corner shown in FIG. 2, and

FIG. 5 is a top plan view showing the sharpened forward portion of a leg of the corner angle member.

Figure 1:
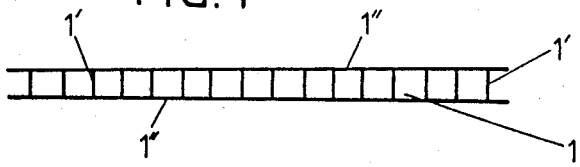
Figure 2:
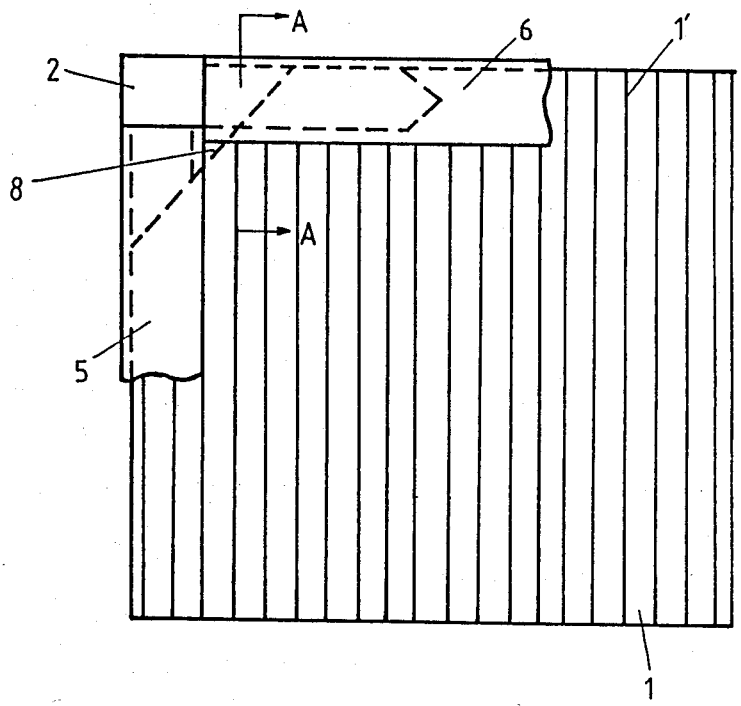

By way of example, a right-angled corner joint of a rectangular double-faced webbed panel unit is shown. The invention may be applied to any desired angles.

The double-faced webbed panel unit comprises a double-faced webbed panel 1, which at its edges is bordered by sections. At the corners of the double-faced webbed panel unit the sections are joined to each other and to the double-faced webbed panel 1 by means of a corner angle member 2. The corner angle member 2 is preferably mass-produced from plastic at low cost and comprises a leg 3, which conforms to the interior of one bordering section 5 and which is inserted into the bordering section 5 during the assembling. The other leg 4 is also dimensioned to be insertable into the other bordering section 6 but is smaller by the extent of the two facings of the double-faced panel 1. The leg 4 is sharpened like a knife at its end 4 and is provided with barblike elevations 7 throughout its length. During the automatic blanking of the double-faced webbed panels 1 to the desired size, a triangular cutout 8 for accommodating a portion of the corner angle member 2 is cut at each corner.

For assembling, the bordering section 6 which extends at right angles to the longitudinal webs 1' of the double-faced webbed panel 1 is fitted on the double-faced webbed panel 1 first. Then the smooth leg 3 of the corner angle member 2 is inserted into that bordering section 5, which is dimensioned to fit the longitudinal side. Thereafter the knife-shaped end 4' of the corner angle member 4 is inserted into the end opening of the bordering section 6, which has previously been fitted on the double-faced webbed panel 1. When the bordering section 5 associated with the longitudinal side is subsequently forced into position, the corner angle member 2 is forced into the end opening of the bordering section 6 at the same time. In that operation the barblike elevations of the leg 4 force the two facings 1'' of the double-faced webbed panel 1 against the inside surfaces of the bordering section 6 whereas the knife-shaped, pointed end 4' during its insertion cuts through the thin cell walls or longitudinal webs 1' extending at right angles. As a result, the two facings 1'' are fixed throughout the length of the leg 4 by the barblike elevations of the corner angle member 2 against a displacement in the transverse direction. Projections 9 or noses protruding inwardly from the inside surface of the bordering section 6 prevent a displacement of the facings 1'' of the double-faced webbed panel 1 in the longitudinal direction. Said projections 9 prevent also a displacement of the bordering section 5 which is disposed on the longitudinal side because the smooth leg 3 of the angle 2 bears also on projections 10 or noses. When all four corner joints have been forced into position, the double-faced webbed plate 1 has reliably been joined to the bordering sections embracing said panel, without a need for additional means, and the bordering sections have also been fixed in all directions but provide for an adequate play for thermal expansion because the double-faced webbed panel is fixed only at its corners.

I claim:

1. A double-faced webbed panel unit, which is bordered at its edges by sections which abut at an angle to each other, characterized in that two abutting sections (5, 6) are connected to each other and to the double-faced webbed panel (1) by a two-legged corner angle member (2), which is disposed in a cutout (8) of the double-faced webbed panel (1) and the legs (3, 4) of which extend in and snugly conform to the ends of the two sections (5, 6) and at least at one end of the section each of those edge portions of the two facings (1″) of the double-faced webbed panel (1) which protrude into the interior of the section (6) is disposed between that leg (4) of the corner angle member (2) that has been inserted into the end of the section and the adjacent inside surface of the section.

2. A double-faced webbed panel unit according to claim 1, characterized in that one leg (4) of the corner angle member (2) extends in the end of one section (6) between the two facings (1″) of the double-faced webbed panel (1) and its other leg (3) extends in that portion of the end of the other section (5) which is free of the double-faced webbed panel (1).

3. A double-faced webbed panel unit according to claim 1, characterized in that both legs of the corner angle member extend in the ends of both sections between the two facings of the double-faced webbed panel.

4. A double-faced webbed panel unit according to claim 1, characterized in that the two facings (1″) of the double-faced webbed panel (1) are clamped between the adjacent inside surface of the section and the adjacent leg (4) of the corner angle member (2).

5. A double-faced webbed panel unit according to claim 1, characterized in that at least one leg (4) of the corner angle member (2) is sharpened like a knife for cutting through the webs (1′) of the double-faced webbed panel (1).

6. A double-faced webbed panel unit according to claim 1, characterized in that at least one leg (4) of the corner angle member (2) is provided with barblike elevations (7) for fixing the double-faced webbed panels (1) in the adjacent section end.

7. A double-faced webbed panel unit according to claim 1, characterized in that the legs (3) of the corner angle member (2) engage projections (10) protruding from the inside surface of the sections (5).

8. A double-faced webbed panel unit according to claim 7, characterized in that each section is provided on its inside surface with projections (9, 10), which interengage with the adjacent leg (3, 4) of the corner angle member (2).

* * * * *